US005492155A

United States Patent [19]

Nishide et al.

[11] Patent Number: 5,492,155

[45] Date of Patent: Feb. 20, 1996

[54] WIRE LAYING-OUT APPARATUS

[75] Inventors: Yutaka Nishide; Akira Gotoh, both of Osaka; Fujio Ogawa; Yasuhiro Deguchi, both of Yokkaichi, all of Japan

[73] Assignees: Sumitomo Electric Industries, Ltd.; Sumitomo Wiring Systems, Ltd., Japan

[21] Appl. No.: 226,047

[22] Filed: Apr. 11, 1994

[30] Foreign Application Priority Data

Apr. 14, 1993 [JP] Japan ..... 5-087629

[51] Int. Cl.[6] ..... B21F 23/00

[52] U.S. Cl. ..... 140/92.1; 29/755

[58] Field of Search ..... 140/92.1, 93 R; 29/755, 794, 868

[56] References Cited

U.S. PATENT DOCUMENTS 3,699,630 10/1972 Tarbox et al. ..... 29/755
5,082,253 1/1992 Suzuki et al. .
5,205,329 4/1993 Suzuki et al. .

FOREIGN PATENT DOCUMENTS 60-46488 10/1985 Japan .
1-22183 9/1989 Japan .

*Primary Examiner*—Lowell A. Larson
*Attorney, Agent, or Firm*—Beveridge, DeGrandi, Weilacher & Young

[57] ABSTRACT

A wire laying-out apparatus automatically lays out an electric wire on a wire laying-out plate. The electric wire is laid out by a wire laying-out head which is freely moved on the wire laying-out plate by an X-direction feed shaft and a Y-direction feed shaft. A plurality of wire guiding devices are arranged in a linear manner on the wire laying-out head. A selecting device is provided in the vicinity of the wire guiding device. The selecting device selects one of the wire guiding devices. It is possible to lay out the electric wire by lowering a wire guiding device. When the electric wire to be laid out is replaced, the electric wires are not tangled. An oblique arch including guide rollers for guiding the electric wires to the wire guiding devices helps inhibit tangling of the wires. In addition, the wire guiding devices are integrated with the wire laying-out head so that the electric wire can be replaced irrespective of the position on the wire laying-out head. Therefore, it takes less time to replace the electric wire.

7 Claims, 16 Drawing Sheets

WIRE LAYING-OUT APPARATUS

CROSS REFERENCE TO RELATED APPLICATION

This application claims priority benefits under 35 USC §119 based on Japanese Patent Application Serial No. 5-87629, the disclosure of which is incorporated by reference.

BACKGROUND OF THE INVENTION

1. Field of the Invention

The present invention relates to a wire laying-out apparatus for automatically laying out electric wires on a wire laying-out plate. More particularly, the present invention relates to a wire laying-out apparatus for laying out electric wires on a wire laying-out plate so as to manufacture a wiring harness.

2. Description of the Art

A wiring harness mounted on an automobile or the like is constructed by bundling electric wires, which differ in color and thickness, cut to predetermined lengths. The wiring harness has flexibility and has a long narrow and complicatedly branched structure. At the time of manufacturing the wiring harness, a wire laying-out plate is used. The electric wires are laid out in a predetermined configuration on the wire laying-out plate.

A wire laying-out apparatus is disclosed in Japanese Patent Publication No. 46488/1985 and Japanese Patent Laid-Open Gazette No. 221813/1989 as the prior art of interest to the present invention.

In the wire laying-out apparatus disclosed in Japanese Patent Publication No. 46488/1985, a wire laying-out head 201 comprises a plurality of wire holders 202 for, each for holding an electric wire W, and a rotating plate 203 for rotating the plurality of wire holders 202, as shown in FIG. 15. The rotating plate 203 is rotated to select the desired wire holder 202. The wire laying-out head 201 is moved along an X-axis 204 and a Y-axis 205, to lay out the electric wire W held in the selected wire holder 202 on a wire laying-out plate 206.

The wire laying-out apparatus disclosed in Japanese Patent Laid-Open Gazette No. 221813/1989 as the other prior art is shown in FIG. 16. This wire laying-out apparatus uses the same wire laying-out plate 211 as that in the present invention. Specifically, the wire laying-out plate 211 comprises a plurality of clamps 200 on one side extending in the X direction. A plurality of wire holders 212, each for holding an electric wire W, which face the clamps 200 and are arranged in the X direction are provided in the vicinity of the wire laying-out plate 211. At the time of laying, the wire holders 212 are moved along an X-axis 216, to oppose the wire holder 212 to be selected to the wire laying-out head 213. At the same time, the wire laying-out head 213 is moved toward the wire holders 212 along a Y-axis 215, to hold the wire holder 212 opposed thereto. Further, the wire laying-out plate 211 is moved along an X-axis 214, to oppose the desired clamp 200 to the selected wire holder 212. The forward end of the electric wire W held by the selected wire holder 212 is clamped by the clamp 200 opposed thereto. Thereafter, the wire laying-out head 213 is moved in the direction of the Y-axis 215, and the wire laying-out plate 211 is moved in the direction of the X-axis 214, to lay out the electric wire W on the wire laying-out plate 211.

In the wire laying-out apparatus in the prior art, the electric wire is tangled at the time of replacing the electric wire, and it takes time to replace the electric wire, so that it takes time to lay out the electric wire.

More specifically, in the wire laying-out apparatus shown in FIG. 15, the rotating plate 203 is rotated, to select the desired wire holder 202 out of the plurality of wire holders 202. The wire holder 202 is rotated by rotating the rotating plate 203. If the number of wire holders 202 is increased, the electric wire W held in each of the wire holders 202 is easily tangled at the time of rotation. If the electric wire W is tangled, the laying operation is interrupted. Therefore, the speed of the laying operation is not satisfactorily increased. Particularly when the number of types of electric wires to be laid out is increased, this problem is noticeable.

In the wire laying-out apparatus shown in FIG. 16, when the electric wire to be laid out is replaced, the wire laying-out head 213, the wire laying-out plate 211 and the wire holder 212 must be respectively moved to predetermined positions where the electric wire is replaced along the Y-axis 215, the X-axis 214 and the X-axis 216. When the electric wire is replaced, the movement of the wire laying-out head 213, the wire laying-out plate 211 and the wire holder 212 from the position where laying is terminated to the position where the electric wire is replaced is indispensable, so that it takes time to replace the electric wire.

SUMMARY OF THE INVENTION

An object of the present invention is to provide an automatic wire laying-out apparatus capable of holding several types of electric wires to be laid out, selecting an electric wire to be laid out of the held electric wires in a short time, and laying out the selected electric wire on a wire laying-out plate.

Another object of the present invention is to provide an automatic wire laying-out apparatus capable of replacing, even if several types of electric wires are held, an electric wire to be laid out in a short time without tangling the electric wire at the time of selecting the electric wire.

Still another object of the present invention is to provide an automatic wire laying-out apparatus having a wire laying-out head suited to simultaneously hold several types of electric wires.

In summary, the present invention comprises a moving mechanism for moving a wire laying-out head in the X direction and the Y direction orthogonal to the X direction on a wire laying-out plate fixed to a predetermined position. The wire laying-out head is arbitrarily moved on the wire laying-out plate by the moving mechanism. Electric wires are laid out on the wire laying-out plate by moving the wire laying-out head.

The wire laying-out head comprises a plurality of wire guiding devices arranged in a linear shape. Different electric wires are respectively fed to each wire guiding device. The wire laying-out head further comprises a selecting device which can be moved in the direction in which the plurality of wire guiding devices are arranged, that is, in the Y direction. The selecting device is moved in the Y direction and is stopped in an arbitrary position, to select the corresponding wire guiding device. The wire laying-out head lays out the electric wire held by the selected wire guiding device on the wire laying-out plate.

According to the present invention, the wire guiding devices for holding the electric wires are arranged in a linear shape. In addition, the selecting device is moved in a linear shape on the wire laying-out head and is stopped in an arbitrary position, to select the corresponding wire guiding device. Therefore, at the time of selecting the electric wire, the wire laying-out head need not be rotated, so that the electric wire fed to the wire guiding device is not tangled.

Furthermore, the plurality of wire guiding devices are provided for the wire laying-out head. The wire laying-out head is arbitrarily moved in the X direction and the Y direction on the wire laying-out plate, to lay out electric wires. When the wire laying-out head has laid out a certain electric wire, the other wire guiding device is selected by the selecting device in the position where the laying is terminated without moving the wire laying-out head from the position, thereby making it possible to select an electric wire to be subsequently laid out. Accordingly, it takes less time to replace the electric wire on the automatic wire-laying out apparatus.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
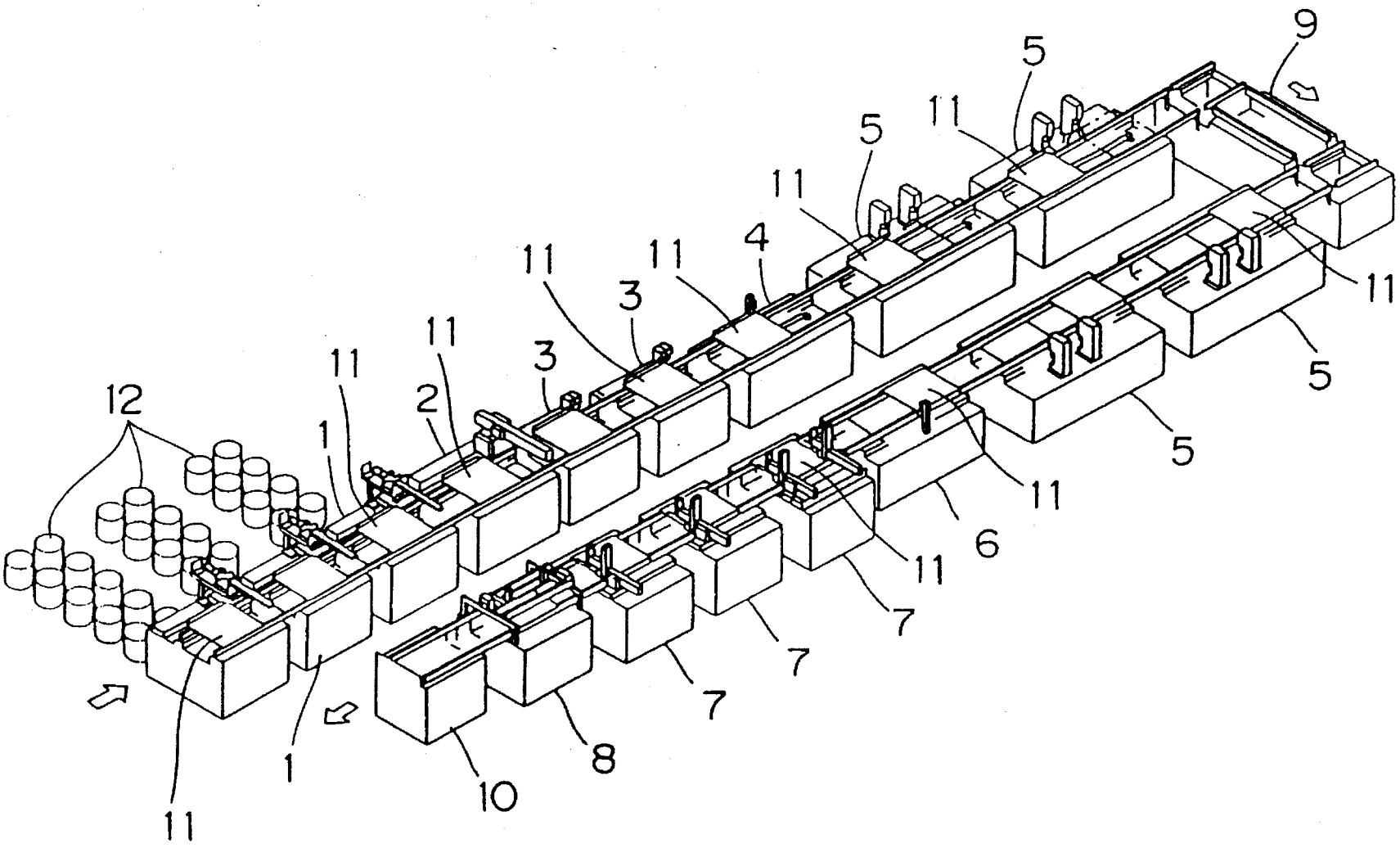
FIG. 1 is a perspective view showing one example of a wiring harness manufacturing line including a wire laying-out apparatus according to one embodiment of the present invention.

FIG. 1 is a perspective view showing one example of a wiring harness manufacturing line including a wire laying-out apparatus according to one embodiment of the present invention. The manufacturing line shown in FIG. 1 is constructed so that a plurality of apparatuses modularized in units of manufacturing processes are arranged and connected to each other in a predetermined number for each process.

More specifically, the manufacturing line comprises a series connection of three automatic wire laying-out apparatuses 1, one automatic taping apparatus 2, two stripping apparatuses 3, one stripping examining apparatus 4, four terminal crimping apparatuses 5, one crimping examining apparatus 6, three terminal inserting apparatuses 7, and one conduction examining apparatus 8. In addition, from such a relationship that the manufacturing line is folded on the downstream side of the second terminal crimping apparatus 5, a conveying buffer module 9 is inserted between the second terminal crimping apparatus 5 and the third terminal crimping apparatus 5. Further, a buffer module 10 is connected to the downstream side of the conduction examining apparatus 8.

When a wiring harness is manufactured in the wiring harness manufacturing line, a wire laying-out plate 11 is conveyed sequentially through the apparatuses from the automatic wire laying-out apparatus 1 to the conduction examining apparatus 8, electric wires are laid out on the wire laying-out plate 11, and the electric wires laid out are subjected to predetermined processing to assemble the wiring harness.

In FIG. 1, reference numerals 12 respectively denote wire supplies. Each of the wire supplies 12 comprises, for example, wound electric wires. Various types of electric wires are respectively fed to the automatic wire laying-out apparatuses 1 from the wire supplies 12.

The wire laying-out apparatus according to one embodiment of the present invention can be used as the automatic wire laying-out apparatus 1 shown in FIG. 1.

Figure 2:
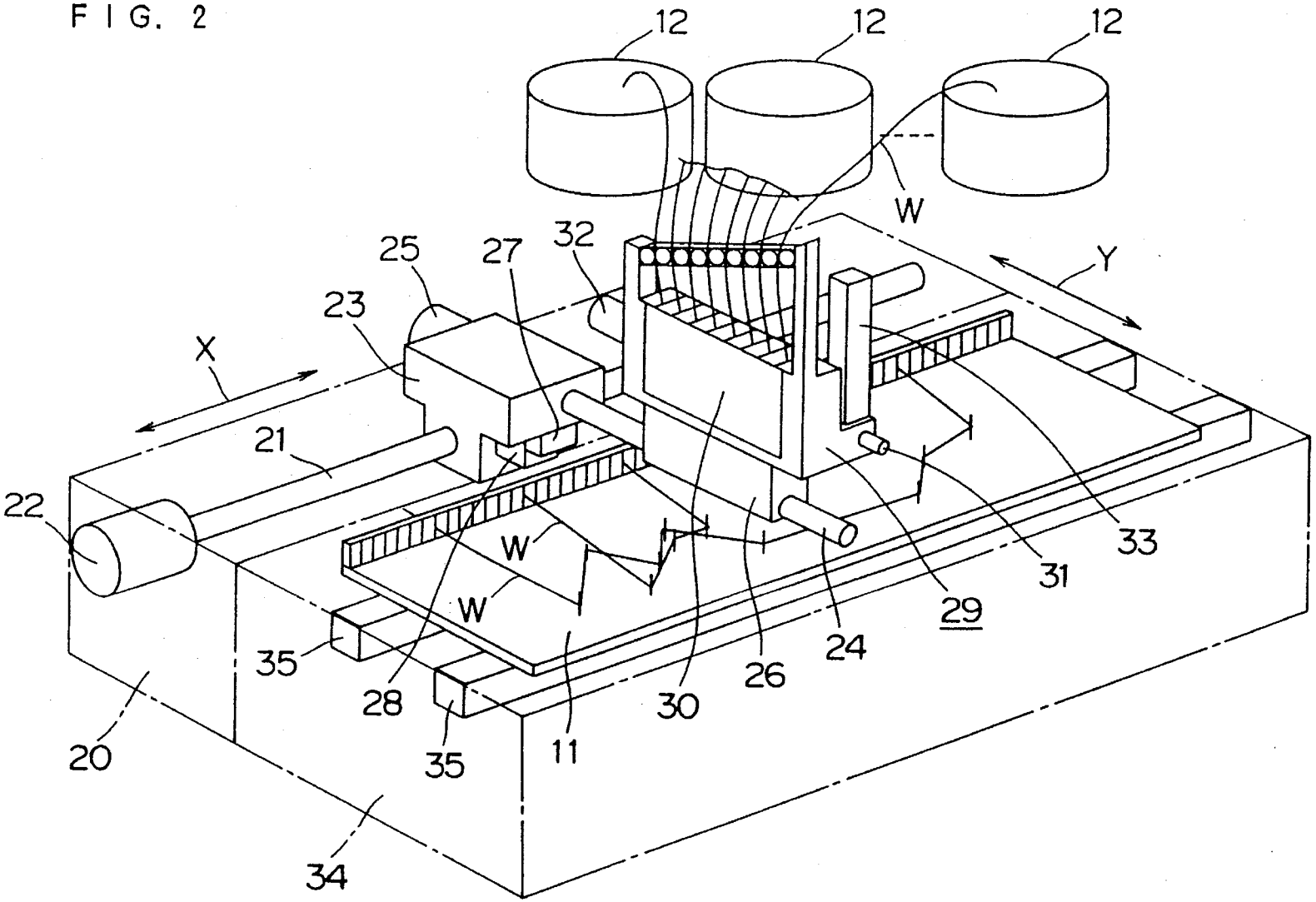
FIG. 2 is a perspective illustration of the entire construction of the wire laying-out apparatus according to one embodiment of the present invention.

FIG. 2 is a perspective view showing the entire construction of the wire laying-out apparatus according to one embodiment of the present invention which can be used as the automatic wire laying-out apparatus 1 shown in FIG. 1. FIG. 2 is such an illustration as to make constituent elements of the wire laying-out apparatus and the relationship between the elements understandable.

Referring to FIG. 2, the wire laying-out apparatus comprises a frame 20, an X-direction feed shaft 21 extending in the X direction which is provided on the frame 20, a motor 22 connected to an end of the X-direction feed shaft 21 for rotating the X-direction feed shaft 21, and an X base 23 movably engaged with the X-direction feed shaft 21. If the X-direction feed shaft 21 is rotated by the motor 22, the X base 23 is moved in the X direction. For example, the X base 23 is moved rightward in FIG. 2 if the X-direction feed shaft 21 is rotated rightward, and it is moved leftward if the X-direction feed shaft 21 is rotated leftward. The amount of movement of the X base 23 is proportional to the amount of rotation of the X-direction feed shaft 21.

The X base 23 is provided with a Y-direction feed shaft 24 extending in the Y direction orthogonal to the X direction, a motor 25 for rotating the Y-direction feed shaft 24, and a Y base 26 movably engaged with the Y-direction feed shaft 24. If the Y-direction feed shaft 24 is rotated by the motor 25, the Y base 26, which is engaged with the Y-direction feed shaft 24, is moved in the Y direction.

The X base 23 is further provided with a wire pressing device 27 and a wire cutting device 28 as described later.

A wire laying-out head 29 is mounted on the Y base 26, The wire laying-out head 29 comprises a plurality of wire guiding devices 30 arranged in the Y direction. Different types of electric wires W are respectively fed to each wire guiding device 30 from a plurality of wire supplies 12. The wire laying-out head 29 further comprises a selecting feed shaft 31 extending in the Y direction, a motor 32 for rotating the selecting feed shaft 31, and a selecting device 33 movably engaged with the selecting feed shaft 31. If the selecting feed shaft 31 is rotated by the motor 32, the selecting device 33 is moved in the Y direction to a position corresponding to the arbitrary wire guiding device 30. The selecting device 33 is operated in the position, whereby the corresponding wire guiding device 30 is selected, and an electric wire W fed to the wire guiding device 30 is laid out.

The above described construction may be replaced with such construction that in the wire laying-out head 29, the plurality of wire guiding devices 30 are arranged in a linear shape in the X direction, the selecting feed shaft 31 also extends in the X direction, and the selecting device 33 is moved in the X direction. That is, such construction that the plurality of wire guiding devices 30 are arranged in a linear shape in the horizontal direction and any one of the wire guiding devices 30 selected by the selecting device 33 may be used.

A frame 34 is provided side by side with the frame 20. The frame 20 and the frame 34 are connected and fixed to each other. A wire laying-out plate conveying device 35 is provided on the frame 34. The wire laying-out plate conveying device 35 stops the wire laying-out plate 11 fed from the upstream side in the X direction in a predetermined position, and feeds the wire laying-out plate 11 downward in the X direction when the electric wire has been laid out on the wire laying-out plate 11.

The Y-direction feed shaft 24 extends to the wire laying-out plate 11 which is stopped in a predetermined position by the wire laying-out plate conveying device 35. Therefore, the X-direction feed shaft 21 is rotated to move the X base 23 and the Y-direction feed shaft 24 is rotated to move the Y base 26 in the Y direction, thereby making it possible to make the wire laying-out head 29 movable in the X direction and the Y direction on the wire laying-out plate 11. Accordingly, the electric wire W which is guided by the wire guiding device 30 selected by the selecting device 33 can be laid out on the wire laying-out plate 11.

The present embodiment is characterized in that the wire laying-out head 29 comprises the plurality of wire guiding devices 30, the plurality of wire guiding devices 30 are arranged in a linear shape in the Y direction, and the selecting device 33 for selecting any one of the plurality of wire guiding devices 30 is provided movably in the Y direction.

Such construction makes it possible to replace, when a certain electric wire has been laid out, the electric wire with an electric wire to be subsequently laid out in the position where the laying is terminated without moving the wire laying-out head 29. It is possible to start to lay out the electric wire. Accordingly, time required to replace the electric wire to be laid out is short, thereby making it possible to increase the laying speed.

Furthermore, it is not necessary to rotate the wire laying-out head so as to replace the electric wire as in the conventional apparatus, so that the electric wire is not tangled as the wire laying-out head is rotated.

Description is now made of the specific construction of the wire laying-out apparatus according to one embodiment of the present invention.

Figure 3:
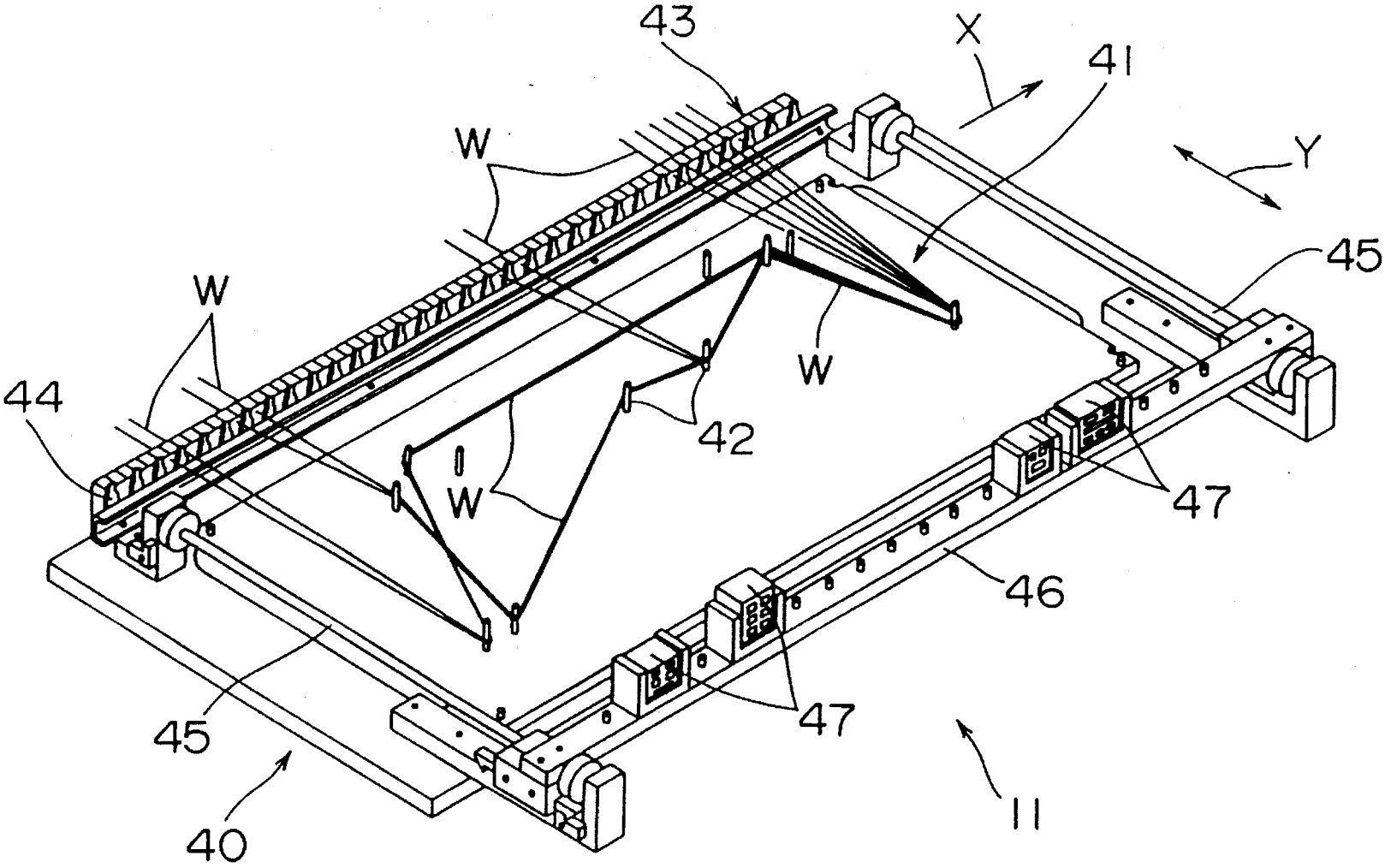
FIG. 3 is a perspective view showing one example of a wire laying-out plate which can be used for the wire laying-out apparatus according to one embodiment of the present invention.

One example of the wire laying-out plate used for the wire laying-out apparatus according to the present embodiment will be first described with reference to FIG. 3. The wire laying-out plate 11 comprises a base plate 40 and a pin board 41 detachably mounted on the base plate 40. Although the base plate 40 can be shared among wiring harnesses irrespective of the shapes of the wiring harnesses, the pin board 41 can be replaced depending on the shapes of the wiring harnesses.

Several wire laying-out pins 42 for hanging electric wires to be laid out are studded on the pin board 41. Several wire clamps 43 are arranged along a long side on the rear side of the base plate 40. Parallel combs 44 are disposed inside of the wire clamps 43. The electric wire W is clamped by a certain wire clamp 43 at its end when it is laid out, and is sequentially hanged on predetermined wire laying-out pins 42 on the pin board 41 through the parallel combs 44, and is clamped by the other wire clamp 43 through the parallel combs 44 in the other end. The electric wire W is cut. Such a laying operation is automatically performed on the wire laying-out plate 11 by the wire laying-out apparatus according to one embodiment of the present invention.

The base plate 40 has a housing mounting plate 46 slidably mounted thereon by slide guide bars 45. The housing mounting plate 46 is slidable in the Y direction, that is, in the longitudinal direction of the base plate 40. The housing mounting plate 46 is positioned in a state where it retreats toward the front of the pin board 41, as shown in FIG. 3, in the processes such as the wire laying-out process, the stripping process in which an insulative sheath at the forward end of the electric wire W is stripped, and the terminal crimping process in which a terminal is crimped on the forward end of the electric wire W. On the other hand, in the terminal inserting process in which the terminal is inserted into a connector housing, the housing mounting plate 46 is slid backward to a position where the terminal is easily inserted into a connector housing 47 mounted on the housing mounting plate 46.

Figure 4:
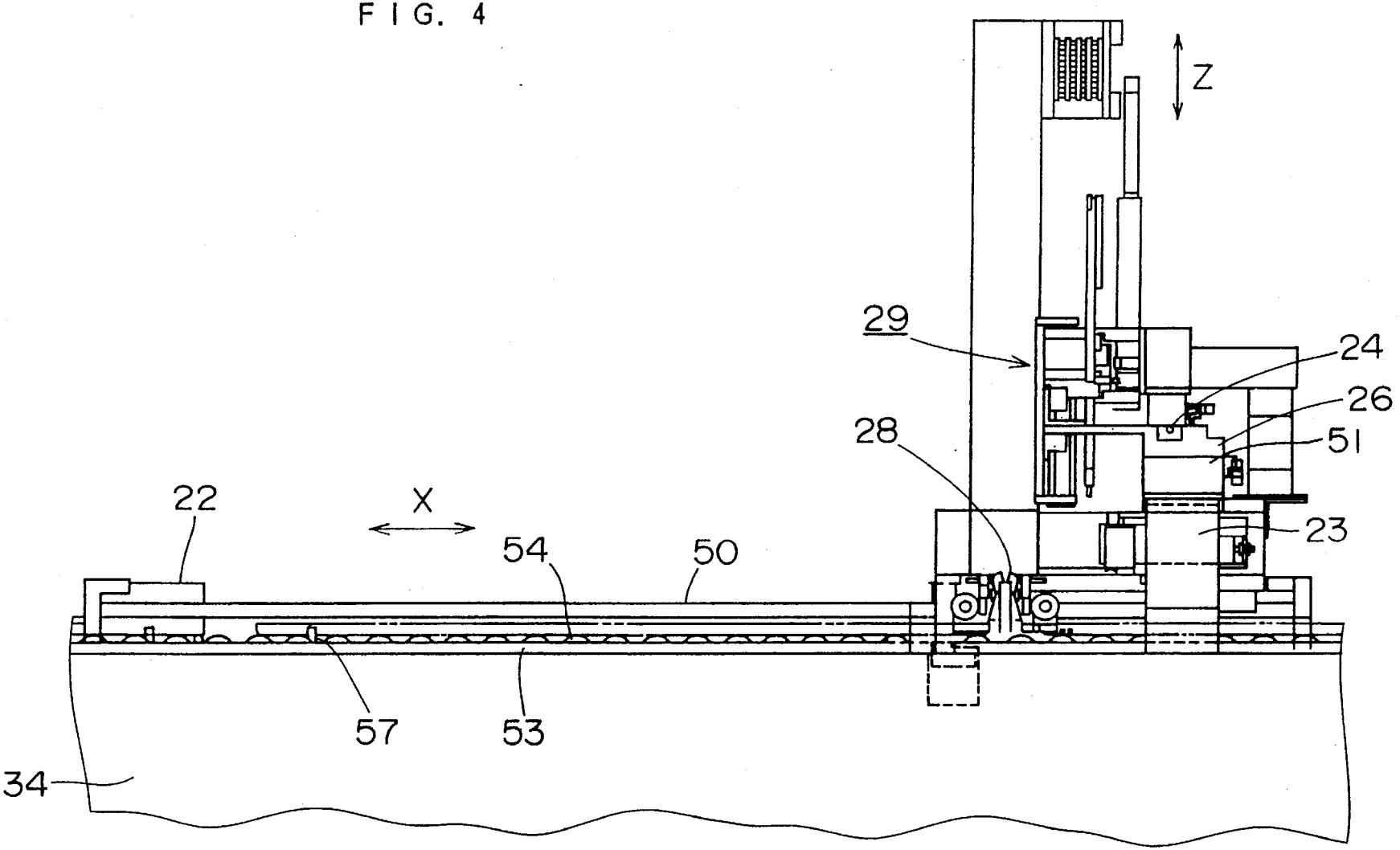
FIG. 4 is a front view showing the wire laying-out apparatus according to one embodiment of the present invention.
Figure 5:
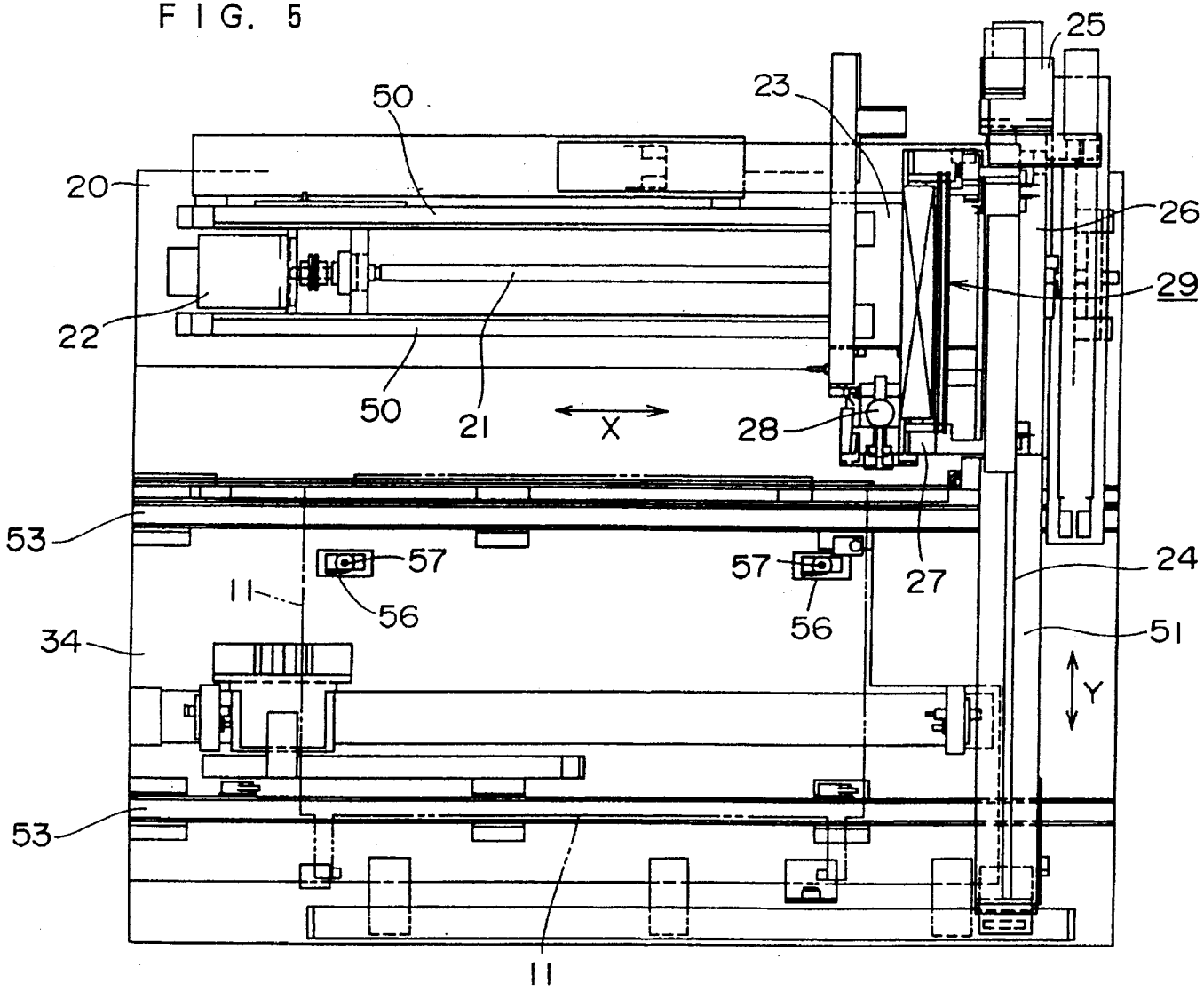
FIG. 5 is a plan view showing the wire laying-out apparatus according to one embodiment of the present invention.
Figure 6:
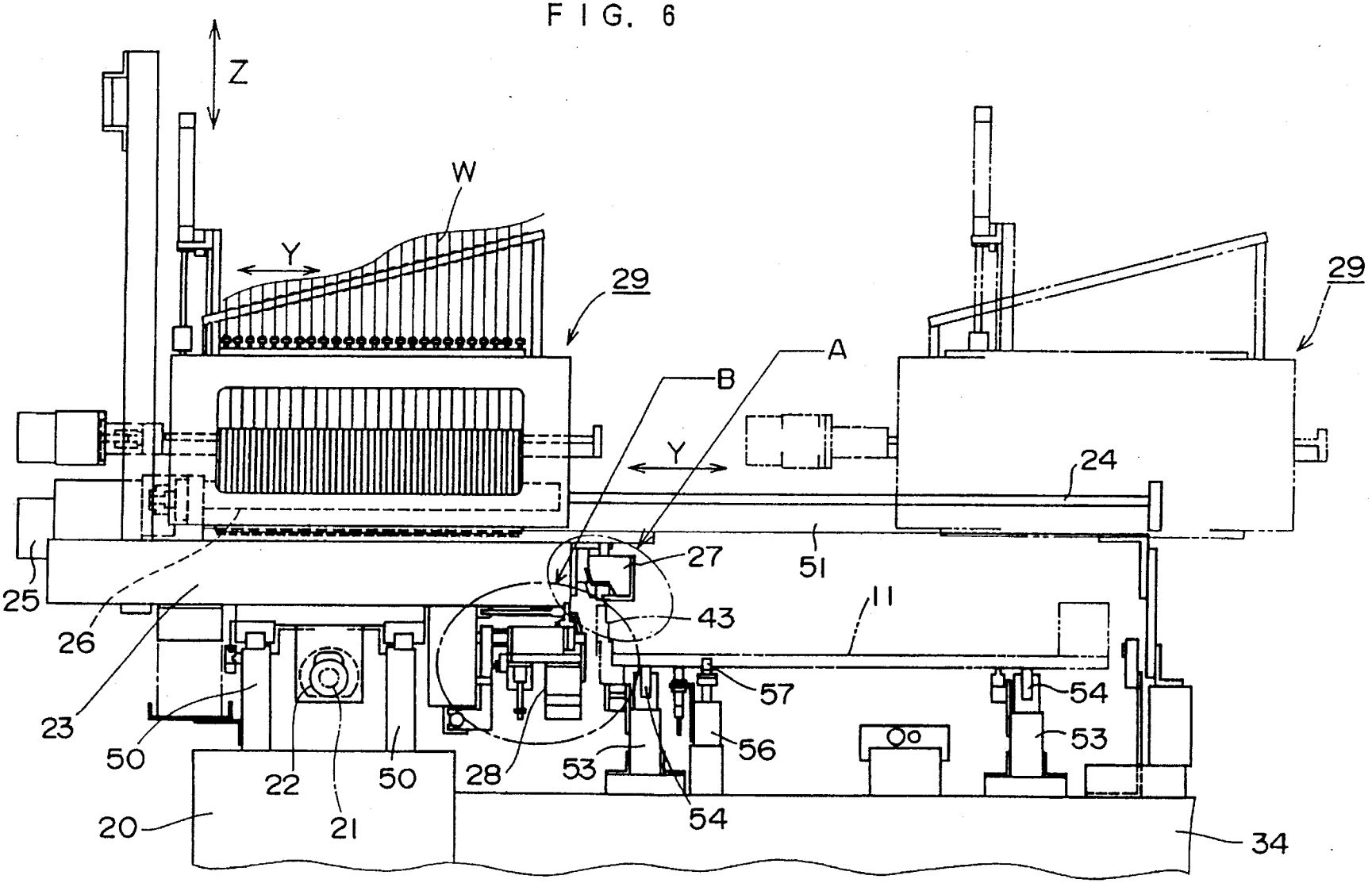
FIG. 6 is a left side view showing the wire laying-out apparatus according to one embodiment of the present invention.

FIG. 4 is a front view showing the wire laying-out apparatus according to one embodiment of the present invention, FIG. 5 is a plan view thereof, and FIG. 6 is a left side view thereof.

Referring to FIGS. 4 to 6, a pair of parallel guide rails 50 extending in the X direction is provided on the frame 20. The X-direction feed shaft 21 parallel to the pair of guide rails 50 is disposed between the guide rails 50. A left end of the X-direction feed shaft 21 is connected to the motor 22. The X base 23 is placed on the guide rails 50. The X base 23 is coupled by key to the guide rails 50, and is movable in the X direction along the guide rails 50. The X-direction feed shaft 21 is further engaged with the X base 23. If the X-direction feed shaft 21 is rotated by the motor 22, the X base 23 is moved in the X direction along the guide rails 50.

A guide rail 51 extending in the Y direction orthogonal to the X direction is mounted on the X base 23. The guide rail 51 extends to the frame 34. The Y base 26 is coupled by key to the guide rail 51. The Y base 26 is movable in the Y direction along the guide rail 51.

The wire laying-out head 29 is mounted on the Y base 26. The motor 25 is provided in a rear end of the guide rail 51. The rotational axis of the motor 25 is connected to the Y-direction feed shaft 24. The Y-direction feed shaft 24 extends parallel to the guide rail 51 in the vicinity of the guide rail 51. A part of the Y base 26 is engaged with the Y-direction feed shaft 24. If the Y-direction feed shaft 24 is rotated by the motor 25, the Y base 26 engaged with the Y-direction feed shaft 24 is moved in the Y direction along the guide rail 51. Consequently, the wire laying-out head 29 mounted on the Y base 26 is also moved in the Y direction.

The frame 34 is connected to the front side of the frame 20. A pair of parallel conveying rails 53 extending in the X direction is disposed on the frame 34. A plurality of rollers 54 are rotatably arranged spaced apart from each other by a predetermined distance on the upper parts of the conveying rails 53, respectively.

The wire laying-out plate 11 is horizontally held by the rollers 54. The wire laying-out plate 11 is conveyed from the upstream side to the downstream side in the X direction, that is, from the left to the right, for example, in FIG. 5. The wire laying-out plate 11 is stopped when it is conveyed to a predetermined position. A positioning cylinder 56 is provided inside of the pair of conveying rails 53 on the frame 34. The cylinder 56 is disposed so that a top end of its rod is directed upward. A pin 57 is provided in the top end of the rod. On the other hand, a positioning hole is formed in a predetermined position on the reverse surface of the base plate 40 (see FIG. 3), for example, of the wire laying-out plate 11. The pin 57 is inserted into this hole so that the wire laying-out plate 11 is reliably stopped in a predetermined position.

The wire pressing device 27 and the wire cutting device 28 are provided on the front side of the X base 23. The wire pressing device 27 is positioned above the wire clamps 43 arranged on the wire laying-out plate 11. The wire cutting device 28 is positioned behind the wire clamps 43.

The wire pressing device 27 is displaceable in the Z direction (the direction orthogonal to the X direction and the Y direction, that is, the up and down direction). The wire pressing device 27 is lowered as described later, thereby to cause the wire clamps 43 to clamp the forward end of an electric wire to be laid out.

The wire cutting device 28 is displaceable in the X direction and the Y direction with respect to the X base 23, as described later. At the time of cutting an electric wire, the wire cutting device 28 is displaced in the X direction and the Y direction, to cut the electric wire.

Figure 7:
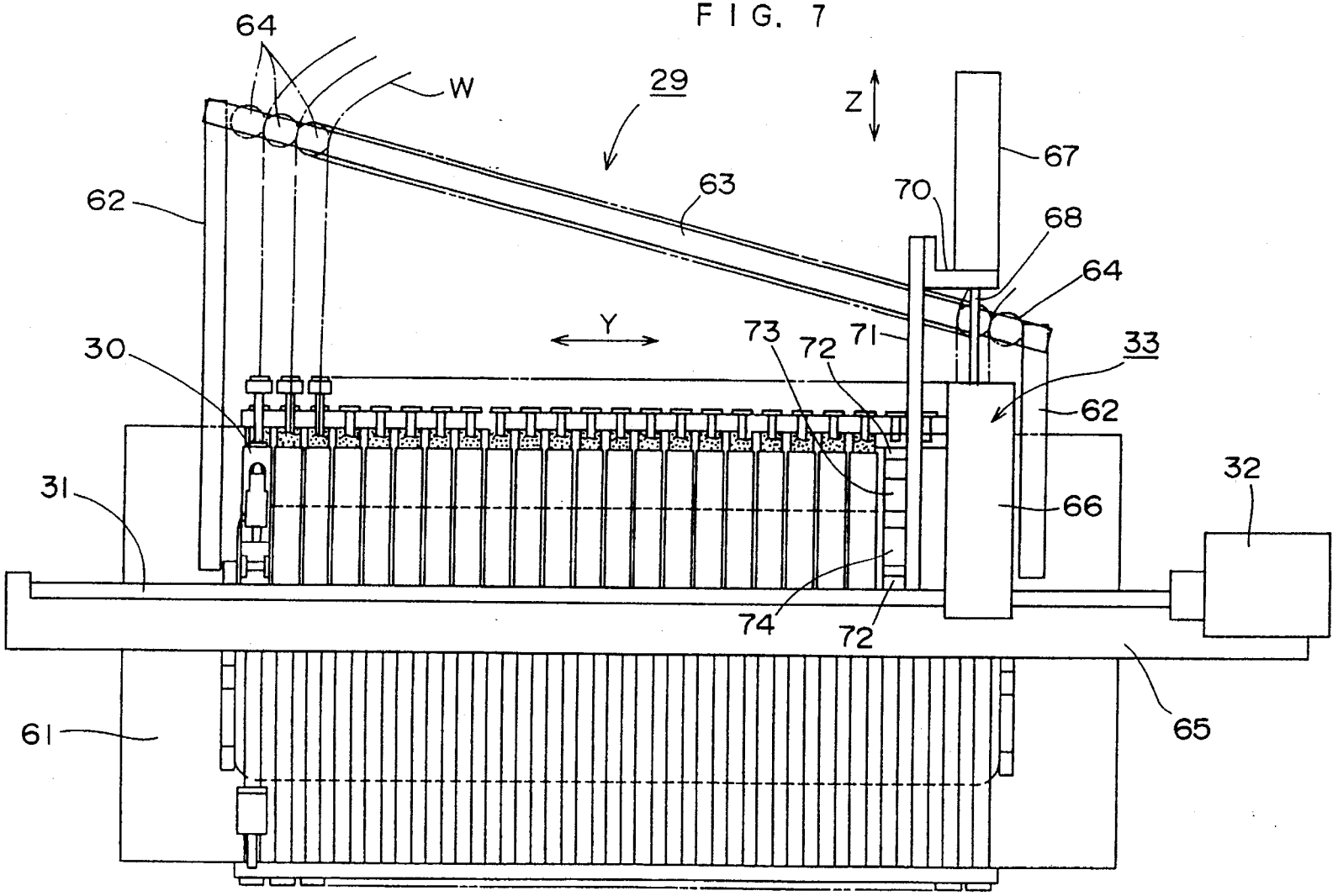
FIG. 7 is a right side view showing a wire laying-out head according to one embodiment.
Figure 8:
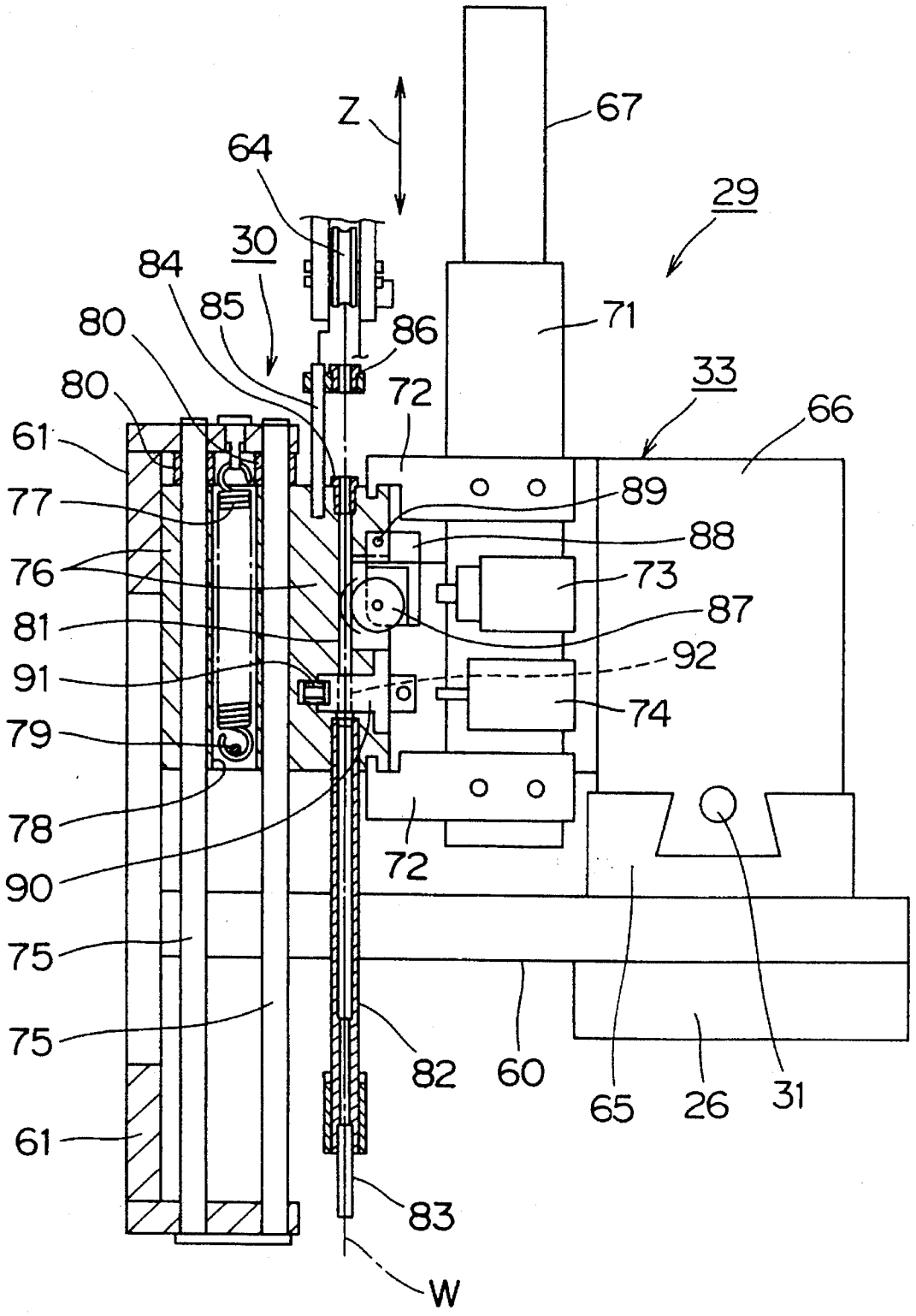
FIG. 8 is a cross sectional view showing a wire laying-out head according to one embodiment.

FIG. 7 is a right side view showing the wire laying-out head 29, and FIG. 8 is a cross sectional view showing the wire laying-out head 29*a*.

Referring to FIGS. 7 and 8, the wire laying-out head 29 is mounted on the Y base 26. The Y base 26 is provided with a connecting plate 60, and a support frame 61 is mounted on the connecting plate 60. The support frame 61 is provided with the plurality of (25 in FIG. 7) wire guiding devices 30 arranged in a linear shape in the Y direction. In addition, supports 62 extending upward are mounted on a front end and a rear end of the support frame 61, and an arch 63 is mounted between upper ends of the two supports 62. One of the supports 62 is made relatively low, while the other support 62 is made relatively high, and the arch 63 is obliquely inclined. A plurality of guide rollers 64 are rotatably arranged in the arch 63. A plurality of electric wires which differ in color, thickness and the like (a maximum of 25 electric wires in the present embodiment), are guided by guide rollers 64 provided for the arch 63, and are fed to the wire guiding devices 30. If the arch 63 is obliquely inclined, the plurality of electric wires to be fed are not easily tangled, as compared with a case where the arch 63 is horizontal.

The wire laying-out head 29 further comprises a slide guide bar 65 extending in the Y direction, a selecting device 33 coupled by key to the slide guide bar 65 and movable in the Y direction along the slide guide bar 65, a selecting feed shaft 31 extending parallel to the slide guide bar 65 and engaged with the selecting device 33 for moving the selecting device 33 in the Y direction, and a motor 32 for rotating the selecting feed shaft 31.

More specifically, the selecting device 33 comprises a holding base 66 coupled by key to the slide guide bar 65. The selecting feed shaft 31 is inserted through the holding base 66. The holding base 66 is moved in the Y direction along the slide guide bar 65 by rotating the selecting feed shaft 31 as described above.

The holding base 66 has a pressing cylinder 67 provided in its upper part. The pressing cylinder 67 is disposed so that its rod 68 extends vertically downward, and a lower end of the rod 68 is fixed to the holding base 66. If the pressing cylinder 67 is operated, and the rod 68 extending upward from the holding base 66 is lengthened or shortened, the pressing cylinder 67 is moved up and down in the Z direction. A longitudinal operating plate 71 extending downward in the Z direction is mounted on the pressing cylinder 67 through a holding member 70. The operating plate 71 is also held slidably in the Z direction by the holding base 66. A pair of upper and lower engaging members 72 which are engaged with the wire guiding devices 30 is mounted on the operating plate 71. In addition, a cylinder 73 for controlling the tension of an electric wire as described later and a cylinder 74 for controlling the permission/stop of wire feeding are mounted on the upper and lower sides between the pair of upper and lower engaging members 72.

In the state shown in FIGS. 7 and 8 where the rod 68 of the pressing cylinder 67 expands, if the holding base 66 is moved in the Y direction along the slide guide bar 65, the pressing cylinder 67 mounted on the holding base 66 and the operating plate 71 connected to the pressing cylinder 67 are also moved in the Y direction. At this time, the pair of engaging members 72 mounted on the operating plate 71 is sequentially engaged with one of the plurality of wire guiding devices 30 opposed thereto by the movement in the Y direction. If the movement of the holding base 66 in the Y direction is stopped, the pair of engaging members 72 is engaged with any one of the plurality of wire guiding devices 30. If the pressing cylinder 67 is operated in the state so that the rod 68 is shortened, the pressing cylinder 67 is lowered in the Z direction. The operating plate 71 is lowered as the pressing cylinder 67 is lowered. Consequently, the wire guiding device 30 with which the engaging members 72 mounted on the operating plate 71 are engaged is lowered in the Z direction. Therefore, one arbitrary wire guiding device 30 is selected out of the plurality of wire guiding devices 30.

Referring now to FIG. 8, the construction of the wire guiding device 30 will be described.

Each of the wire guiding devices 30 comprises a pair of lowering guide bars 75 which are held in the Z direction by the support frame 61, an up-and-down body 76 which is movably engaged in the Z direction with the lowering guide bars 75, and a spring 77 for raising the up-and-down body 76 toward its upper end. The spring 77 is disposed in a through hole 78 extending in the up and down direction which is formed in the up-and-down body 76. An upper end of the spring 77 is engaged with an upper side of the support frame 61, and a lower end of the spring 77 is engaged with a pin 79 projected into the through hole 78 of the up-and-down body 76. Accordingly, the up-and-down body 76 is raised to an upper end of the lowering guide bar 75 by an elastic force of the spring 77 in a state where no external force is applied. At this time, a rubber ring 80 is fitted in the lowering guide bar 75 so that the upper end of the up-and-down body 76 and the upper side of the support frame 61 do not directly strike.

The up-and-down body 76 has a wire guide hole 81 extending in the Z direction formed therein on the opposite side of the selecting device 33.

A guide ring 84 is fitted in an upper end of the wire guide hole 81. The guide ring 84 is provided so that an electric wire passing through the wire guide hole 81 should not harm the insulative sheath of the electric wire by striking a corner or the like of the wire guide hole 81. A support bar 85 projected upward is provided on the upper surface of the up-and-down body 76, and a guide ring 86 is mounted on the support bar 85. The electric wire W guided by the guide roller 64 passes through the upper guide ring 86 and passes through the lower guide ring 84, to be introduced into the wire guide hole 81.

A guide pipe 82 extending downward is provided in a lower end of the up-and-down body 76. The guide pipe 82 is in communication with the wire guide hole 81, to guide the electric wire W passing downward from above through the wire guide hole 81. A nozzle 83 composed of a material which is elastically displaceable is provided in a lower end of the guide pipe 82. The electric wire W is taken out of the nozzle 83.

Two upper and lower notches communicating with the wire guide hole 81 are formed on a side surface, which is opposed to the selecting device 33, of the up-and-down body 76. A tension roller 87 is disposed in the upper notch. The tension roller 87 is rotatably mounted on a cover 88. The cover 88 is swingably mounted on the up-and-down body 76 by a pin 89. In a state where no external force is applied, the cover 88 is directed vertically downward, so that the peripheral surface of the tension roller 87 does not enter into the wire guide hole 81. A rod of the cylinder 73 mounted on the above described operating plate 71 is opposed to the cover 88. If the cylinder 73 is operated, the rod pushes the cover 88. Consequently, the peripheral surface of the tension roller 87 enters into the wire guide hole 81 and presses the electric wire W passing through the wire guide hole 81, to apply tension to the electric wire W.

A stopper member 90 is fitted in the lower notch. The stopper member 90 is always displaced toward the selecting device 33, that is, rightward in FIG. 8, by a spring 91 contained in the up-and-down body 76. The stopper member 90 has a hole 92 extending in the up and down direction formed therein. The hole 92 communicates in a straight line with the wire guide hole 81 when the stopper member 90 is pressed leftward. In a state where the stopper member 90 is displaced rightward, therefore, the hole 92 is shifted from the wire guide hole 81. If the hole 92 is shifted, the electric wire 80 is stopped.

A rod of the above described cylinder 74 is opposed to the right of the stopper member 90. If the cylinder 74 is operated, the rod pushes the stopper member 90, whereby the stopper member 90 is displaced leftward. Consequently, the wire guide hole 81 and the hole 92 of the stopper member 90 communicate in a straight line with each other, thereby making it possible to draw out the electric wire. In the wire guiding device which is not selected, the electric wire cannot be drawn out by the stopper member 90.

The pair of upper and lower engaging members 72 mounted on the operating plate 71 is engaged with upper and lower parts of the up-and-down body 76. If the operating plate 71 is lowered as described above, therefore, the up-and-down body 76 engaged with the engaging members 72 is moved downward in the Z direction against a force of the spring 77. Consequently, the wire guiding device 30 is selected.

Figure 9:
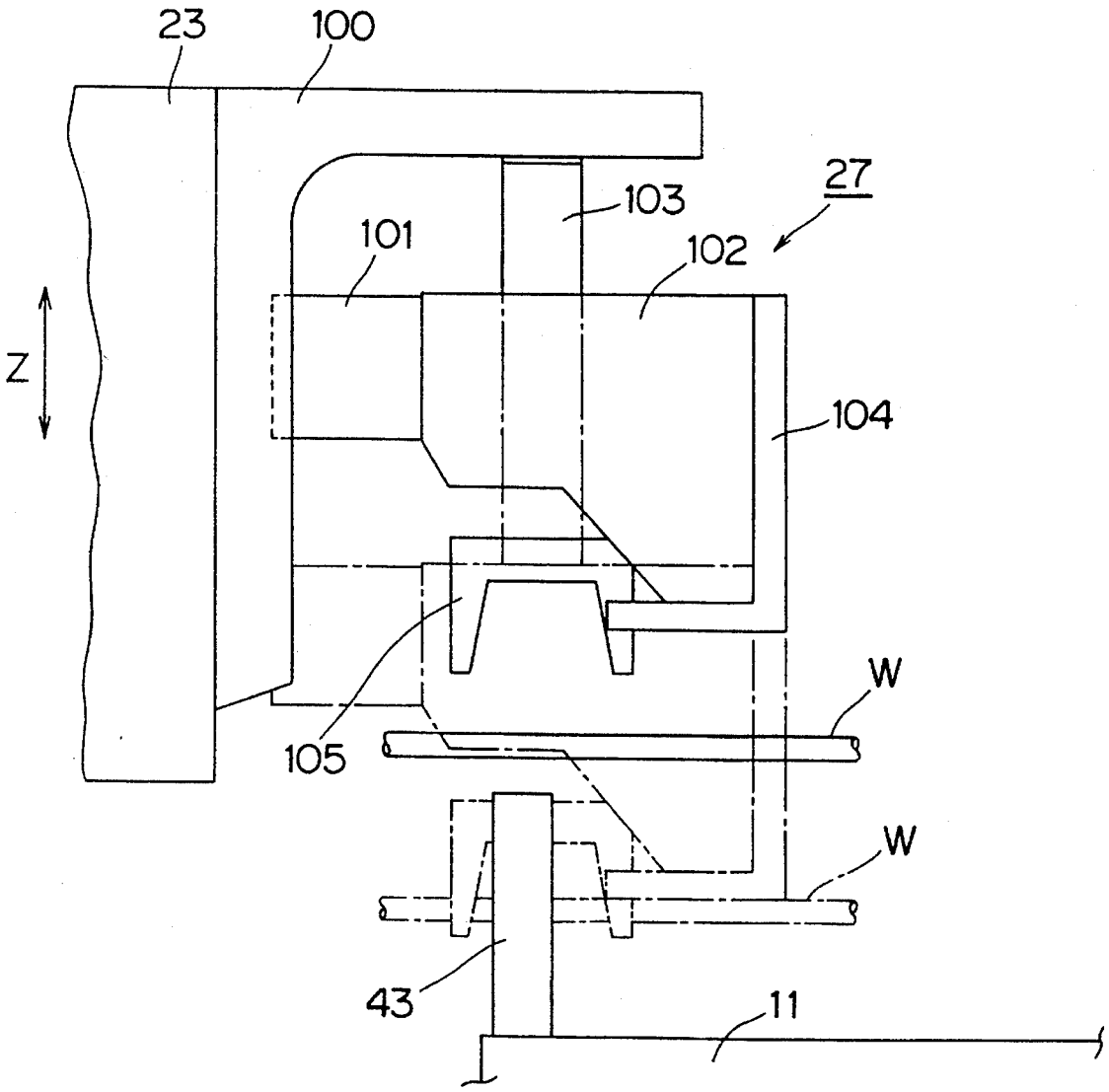
FIG. 9 is an enlarged view of a portion A enclosed by a one-dot and dash line shown in FIG. 6, which shows the construction of a wire pressing device.

FIG. 9 is an enlarged view of a portion A enclosed by a one-dot and dash line shown in FIG. 6, which illustrates the construction of the wire pressing device 27. The wire pressing device 27 comprises a slide guide 100, whose side surface is in an approximately L shape, fastened to the X base 23, and a supporting member 101 engaged with a vertical portion of the slide guide 100 and displaceable in the Z direction along the slide guide 100. A cylinder 102 is connected to the supporting member 101. The cylinder 102 is so disposed that a top end of its rod 103 is directed upward. The top end of the rod 103 is connected to a horizontal portion of the slide guide 100. A pressing arm 105 is provided through a holding plate 104 below the cylinder 102. If the cylinder 102 is driven so that the rod 103 is lengthened, the cylinder 102 and the pressing arm 105 are lowered. When there is an electric wire W stretched almost horizontally over the wire clamp 43 of the wire laying-out plate 11, the electric wire W is pressed by the pressing arm 105, to be clamped by the wire clamp 43.

If the rod 103 of the cylinder 102 is shortened, the cylinder 102 and the pressing arm 105 are raised.

Figure 10:
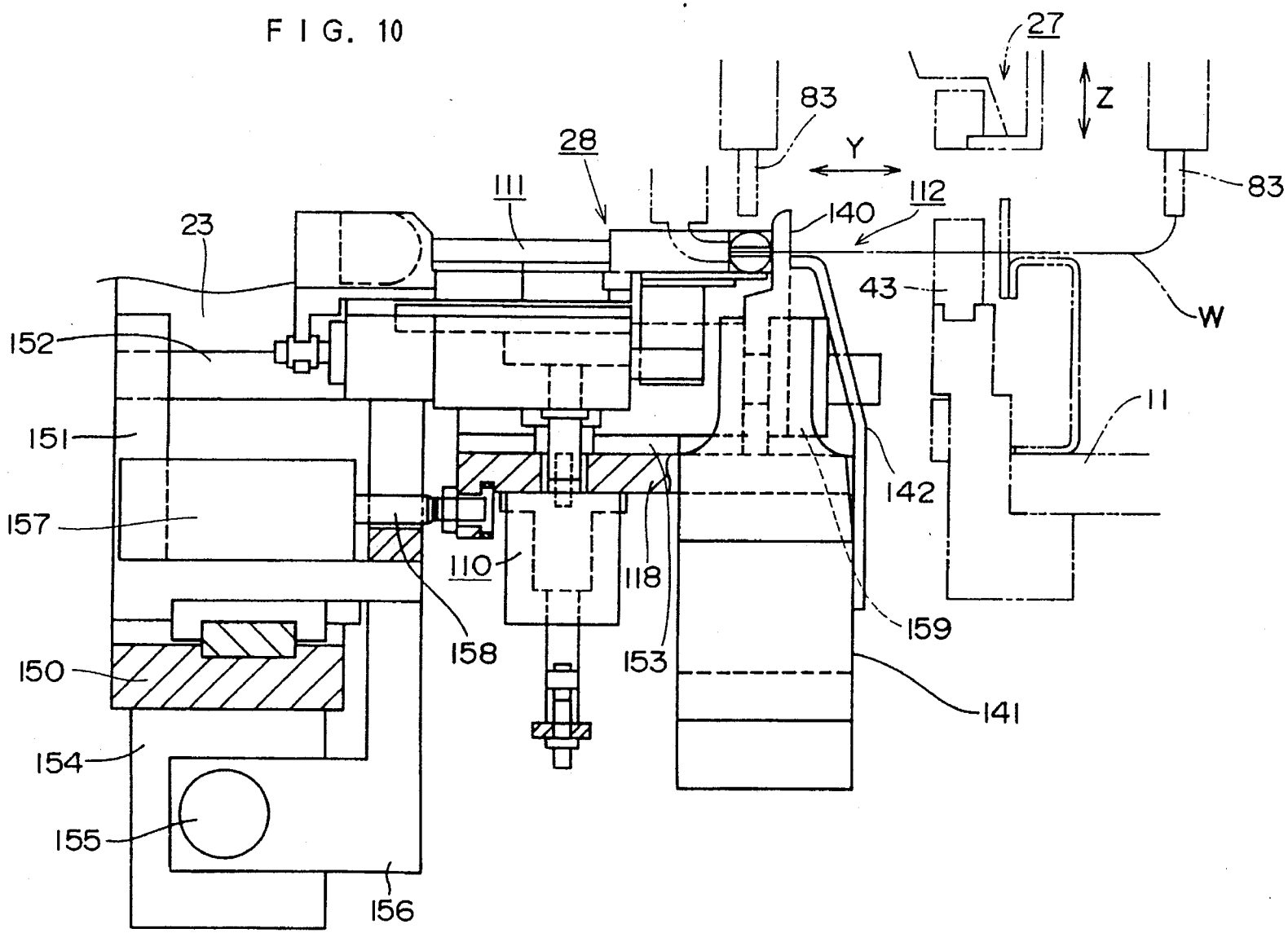
FIG. 10 is an enlarged view of a portion B enclosed by a one-dot and dash line shown in FIG. 6, which shows the construction of a wire cutting device.
Figure 11:
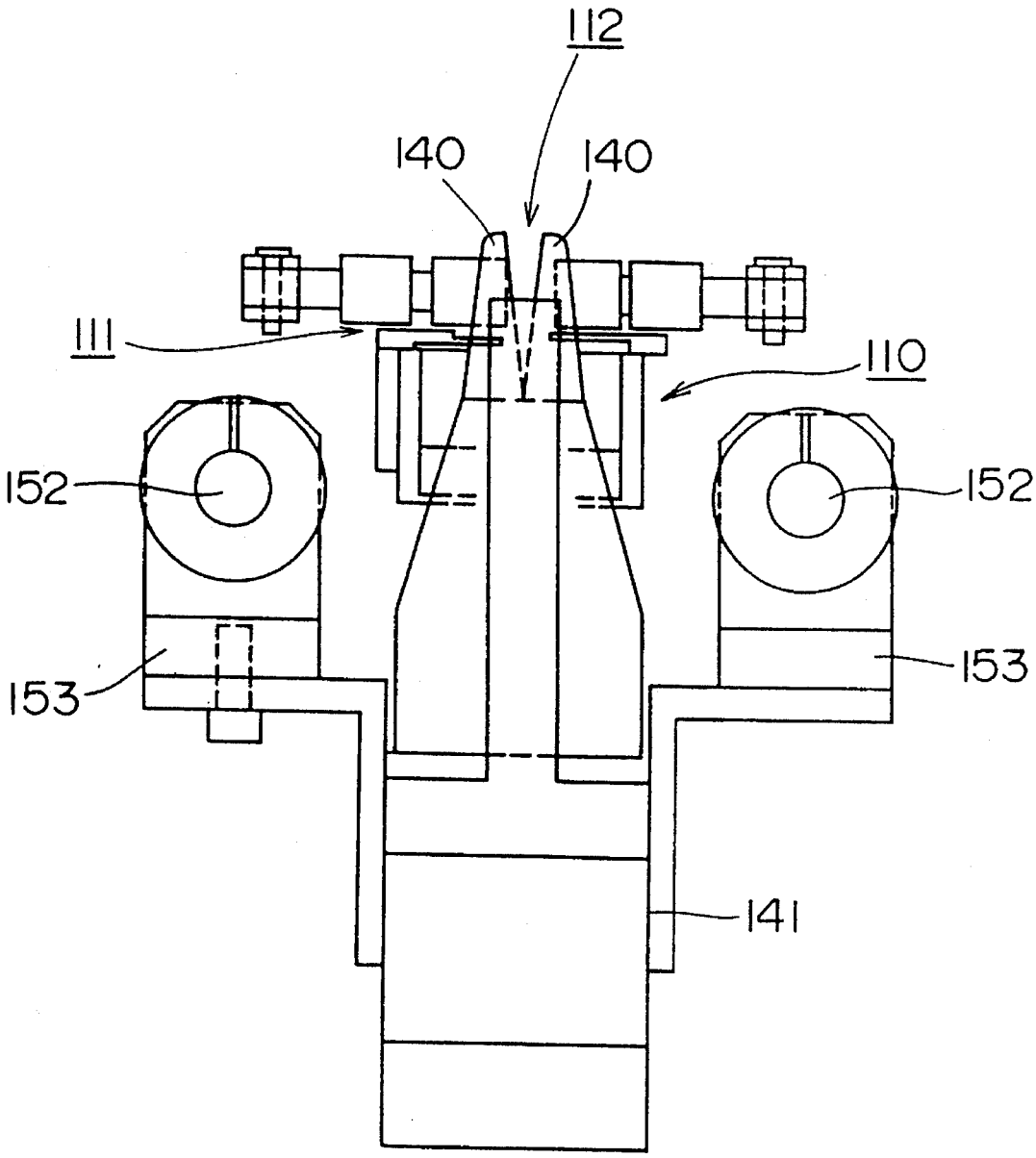
FIG. 11 is a diagram showing the wire cutting device as viewed from the front.

FIG. 10 is an enlarged view of a portion B enclosed by a one-dot and dash line shown in FIG. 6 and is a side view showing the wire cutting device 28. Further, FIG. 11 is a diagram showing the wire cutting device 28 as viewed from the front. The wire cutting device 28 has a structure obtained by integrating a chuck portion 110 for grasping the forward end of the electric wire W projected from the nozzle 83 and drawing out the electric wire W from the nozzle 83, a guide portion 111 disposed above the chuck portion 110 for guiding the electric wire W parallel to the Y direction and holding the same, and a cutting portion 112 disposed ahead of the guide portion 111 for cutting the electric wire W.

Figure 12:
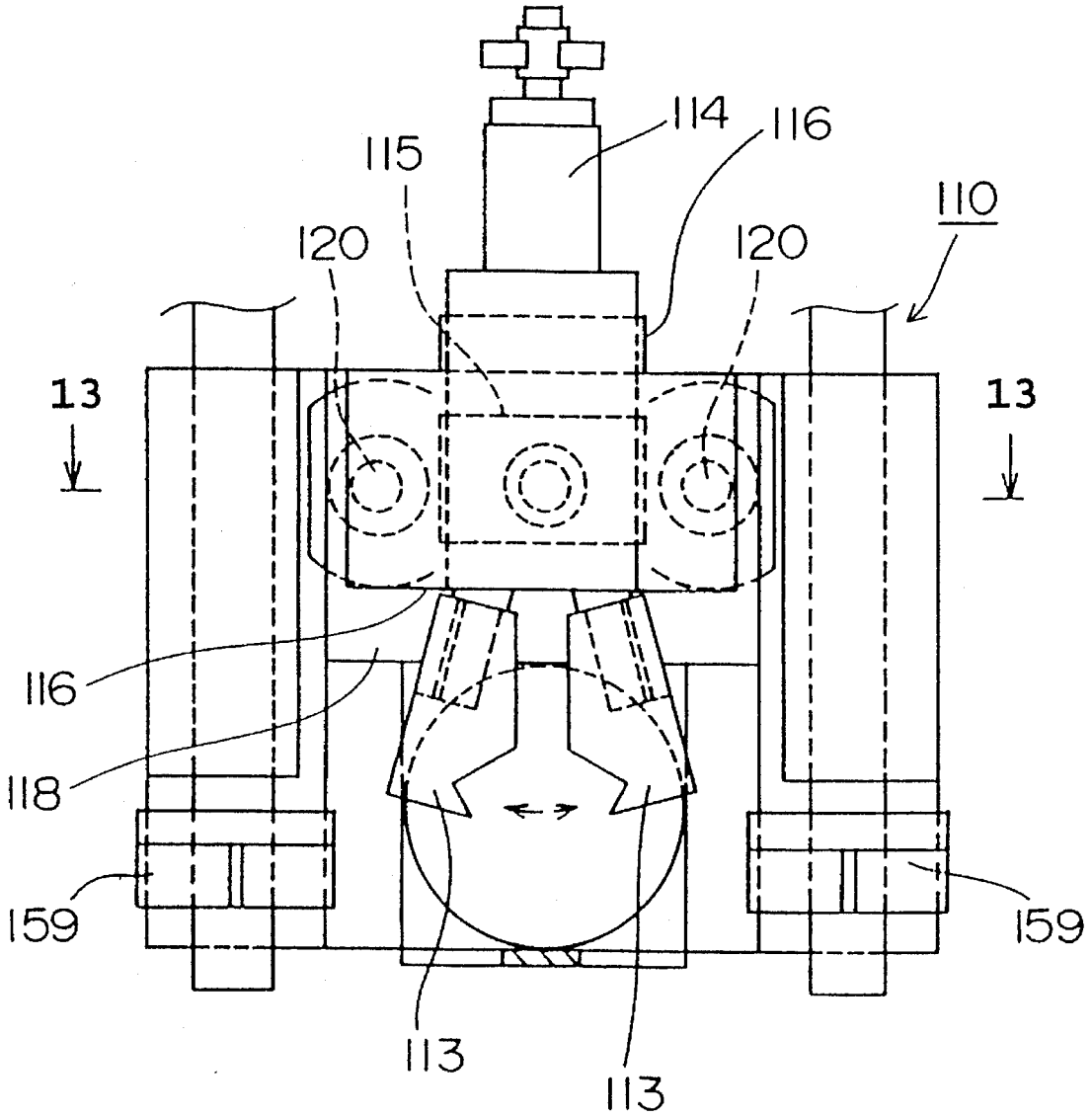
FIG. 12 is a plan view showing only the construction of a chuck taken out of the wire cutting device.
Figure 13:
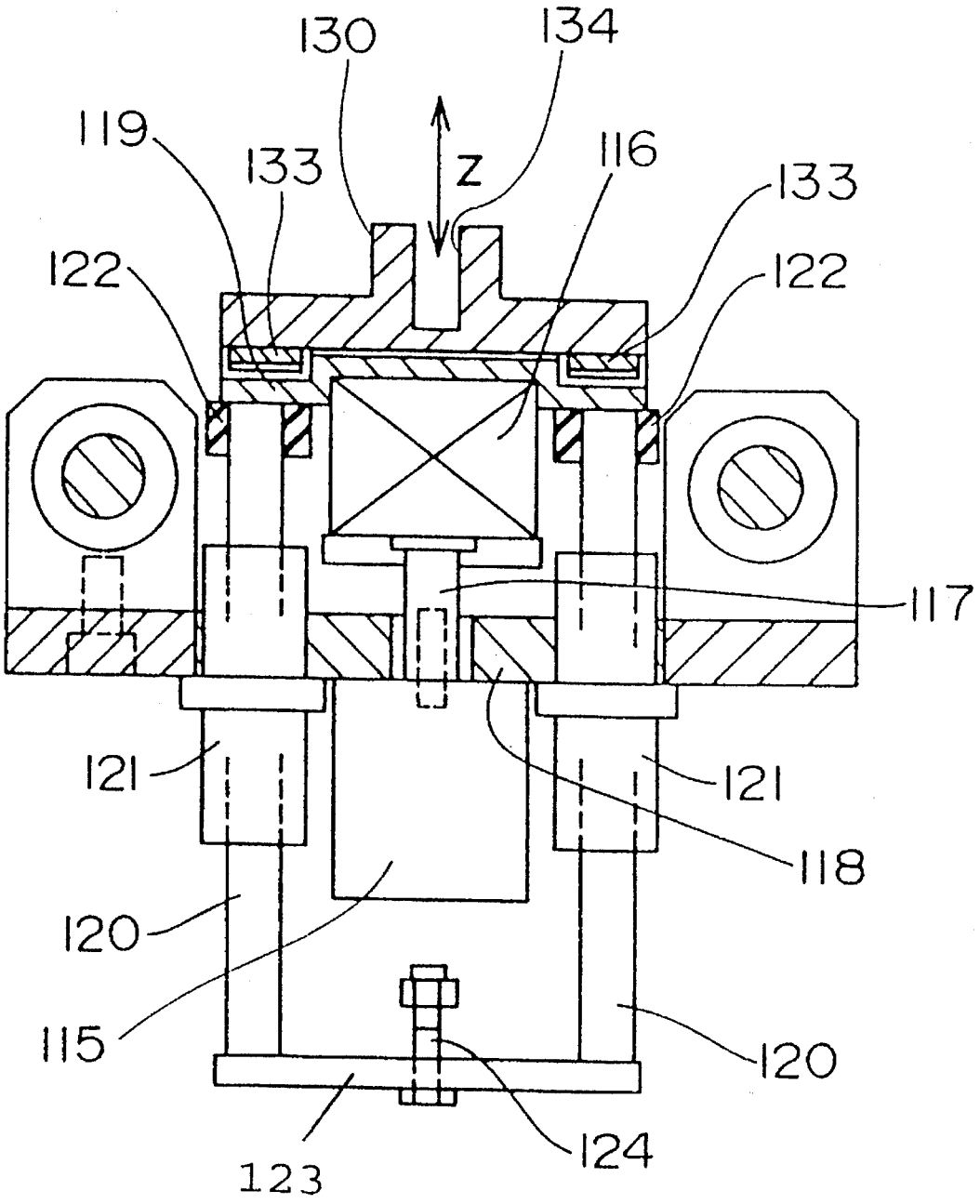
FIG. 13 is a sectional side view in perspective taken along a line 13—13 shown in FIG. 12.

FIG. 12 is a plan view showing only the construction of the chuck portion 110 taken out of the wire cutting device 28, and FIG. 13 is a vertical sectional view in perspective taken along a line 13—13 shown in FIG. 12. Referring to FIGS. 12 and 13, the chuck portion 110 comprises a pair of clutch hands 113 for grasping an electric wire, a chuck cylinder 114 for opening or closing the chuck hands 113, and a lift cylinder 115 for moving the chuck hands 113 up and down. The pair of chuck hands 113 is supported on a housing 116 so that it can be opened or closed. The chuck cylinder 114 is mounted to the rear of the housing 116 with its rod directed sideways. The lift cylinder 115 is disposed below the housing 116 with its rod 117 directed upward. More specifically, a unit base 118 is provided below the housing 116, and the left cylinder 115 is mounted on the lower surface of the unit base 118. An upper end of the rod 117 is connected to the housing 116.

A pair of pins 120 for catching a stop plate 119 mounted on the upper surface of the housing 116 is inserted through the unit base 118. The pins 120 are disposed so as to be opposed to each other with the chuck cylinder 114 interposed therebetween. The pins 120 are in communication with upper and lower parts of the unit base 118 through spools 121, respectively. Rubber rings 122 are respectively fitted in upper ends of the pins 120. Lower ends of the pins 120 are connected to each other by a plate 123. A stopper bolt 124 is mounted on the center of the plate 123.

If the chuck cylinder 114 is operated, the chuck hands 113 are closed to grasp the forward end of the electric wire projected from the nozzle 83. The lift cylinder 115 is operated with the forward end of the electric wire grasped by the chuck hands 113, to gradually lengthen or shorten the rod 117. Consequently, the housing 116 is gradually moved up and down. As a result, the electric wire grasped by the chuck hands 113 is drawn out of the nozzle 83.

Figure 14:
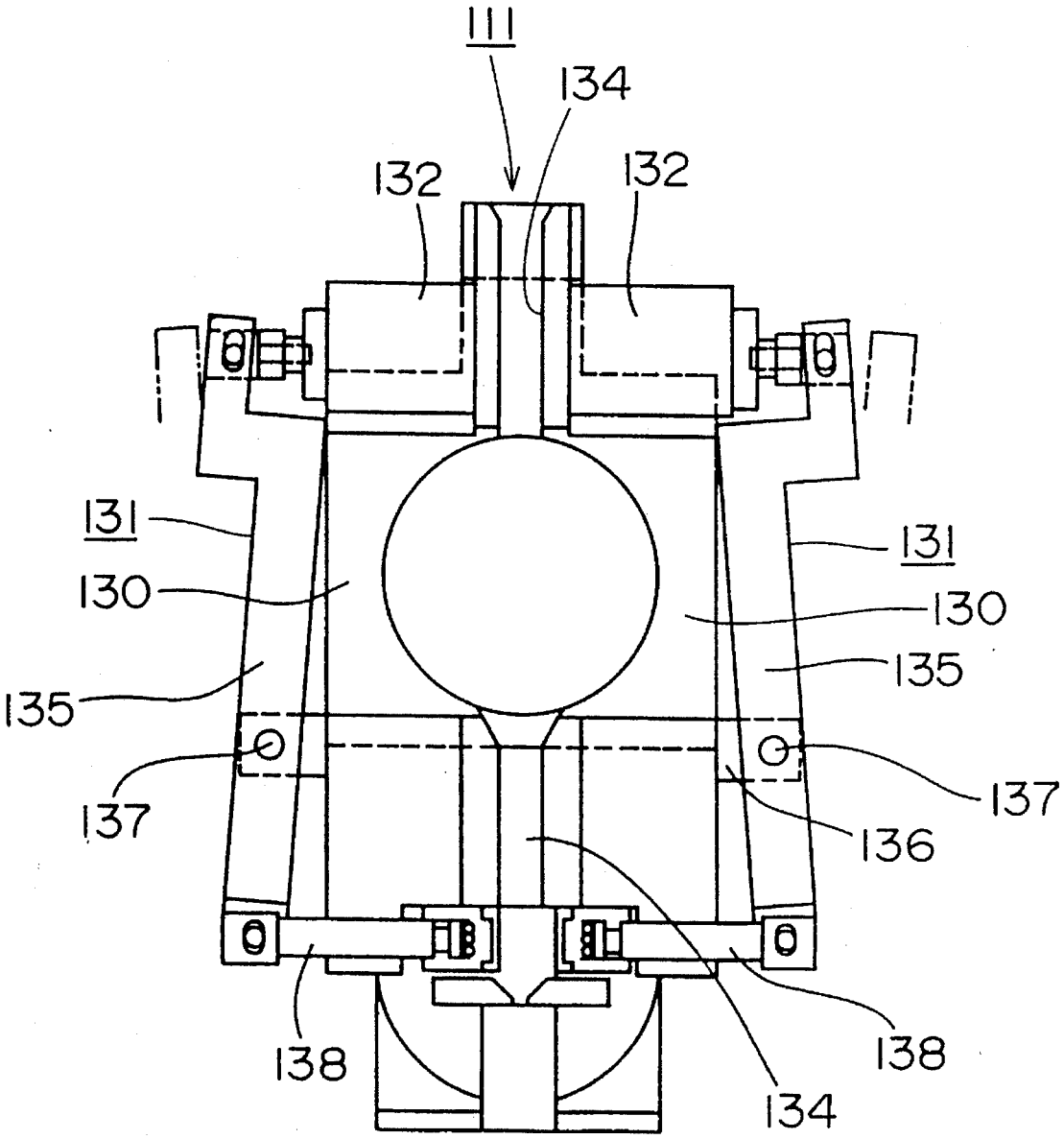
FIG. 14 is a plan view showing a guide portion of the wire cutting device.
Figure 15:
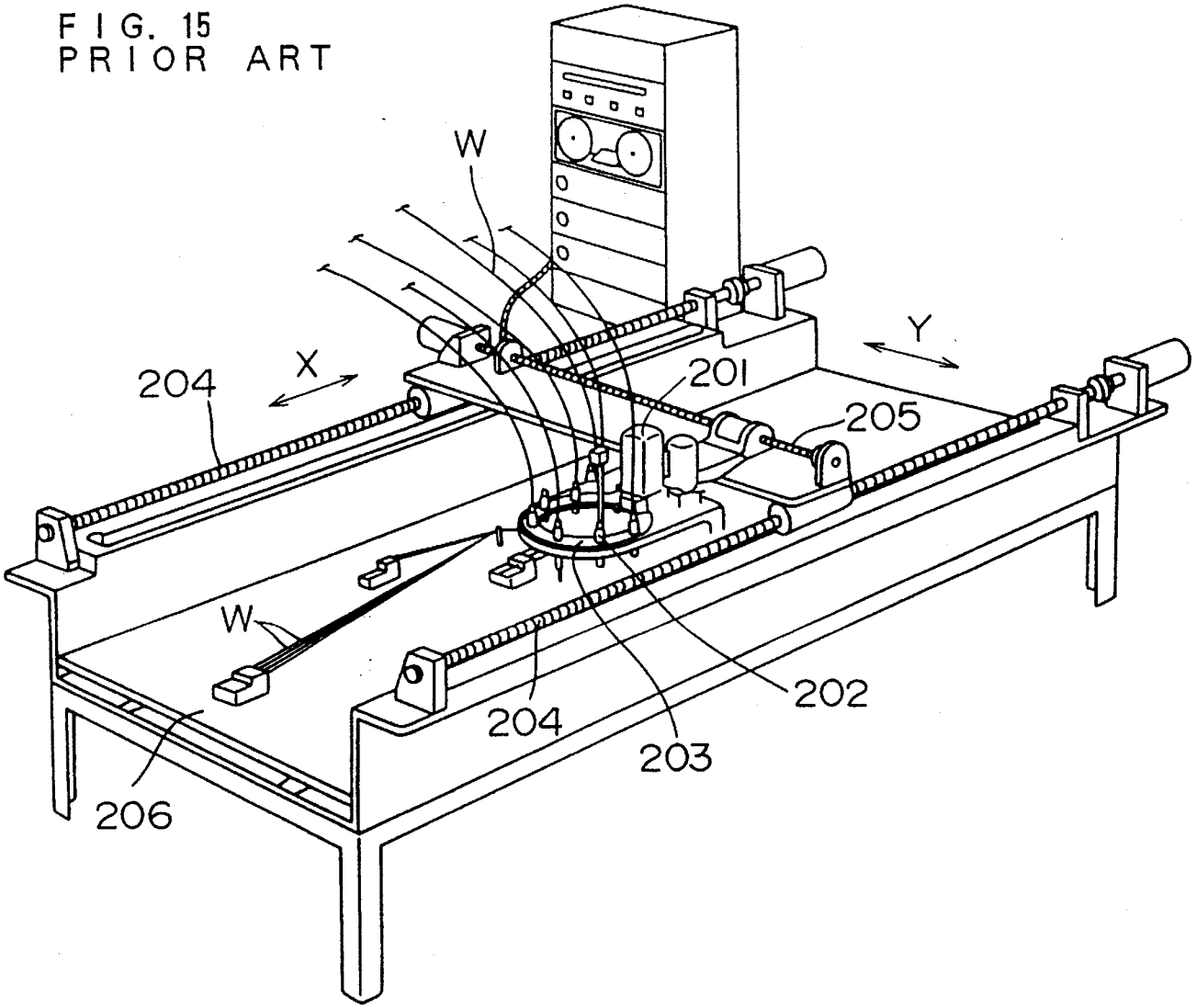
FIG. 15 PRIOR ART
FIG. 15 is a perspective view showing a wire laying-out apparatus in the prior art.
Figure 16:
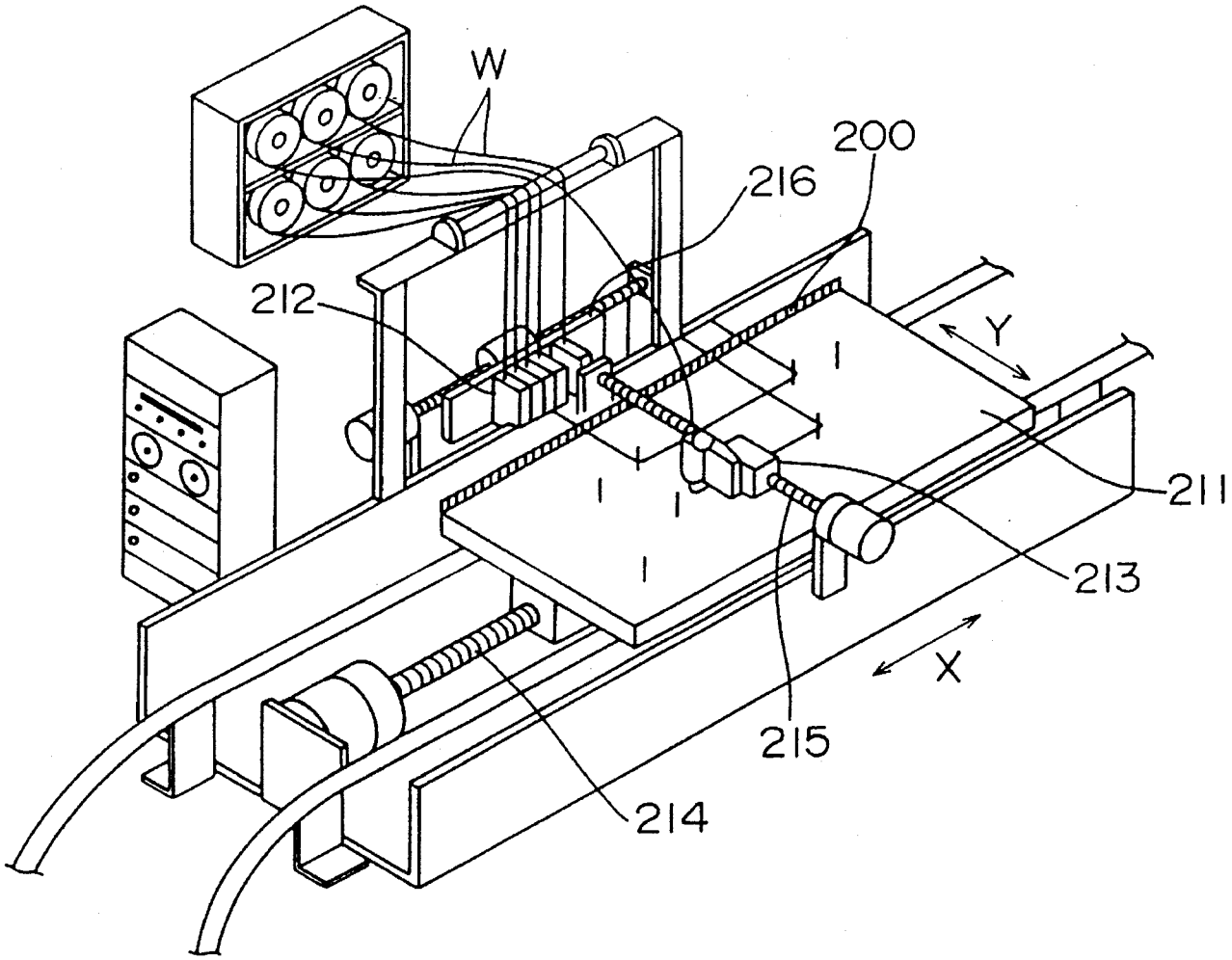
FIG. 16 PRIOR ART
FIG. 16 is a perspective view showing a wire laying-out apparatus in another prior art.

FIG. 14 is a plan view showing the guide portion 111. Referring to FIG. 14 and FIG. 13 as previously described, the guide portion 111 comprises a guide block 130 for guiding an electric wire in the Y direction, a pair of clamp arm mechanisms 131 for holding the forward end of the electric wire guided by the guide block 130, and a pair of cylinders 132 for operating the clamp arm mechanism 131.

The guide block 130 is mounted on the stop plate 119 through linear packs 133, as shown in FIG. 13. A guide groove 134 for guiding the nozzle 83 (see FIG. 10) in the Y direction is provided on the upper surface of the guide block 130, as shown in FIG. 14.

The clamp arm mechanisms 131 comprise a pair of arms 135 disposed on both right and left sides of the guide block 130 and a link plate 136 disposed on the lower surface of the guide block 130 for rotatably supporting the respective arms 135. Respective ends of the link plate 136 are rotatably connected to the arms 135 by pins 137. Clamp claws 138 are respectively connected to front ends of the arms 135. The clamp claws 138 are opposed to each other. Rear ends of the arms 135 are respectively connected to the cylinders 132.

If the pair of cylinders 132 is operated so that a rod of the cylinders is lengthened, a pair of the arms 135 respectively swing around the pins 137, so that the front ends of the arms 135 are displaced nearer to each other. Therefore, the pair of clamp claws 138 connected to the front ends of the arms 135 is closed, to hold the electric wire. On the other hand, if the rod of the cylinders is shortened, the pair of clamp claws 138 is opened, to release the holding of the electric wire.

Referring to FIGS. 10 and 11 again, the cutting portion 112 comprises a cutter blade 140 for cutting the electric wire W, supporting block 141 for supporting the cutter blade 140, and a guide 142 mounted on the front surface of the supporting block 141 for guiding the electric wire W to a shear plane of the cutter blade 140. The supporting block 141 is mounted on an end of the unit base 118. A top end of the guide 142 is folded toward the cutter blade 140.

Furthermore, in the present embodiment, the wire cutting device 28 is provided with a moving mechanism for displacing the wire cutting device 28 in the X direction and the Y direction relative to the X base 23.

Referring to FIGS. 10, 11 and 12, the moving mechanism comprises an X-direction slide rail 150 projected on the lower surface of the X base 23, an X-direction slide base 151 guided in the X direction along the X-direction slide rail 150, a pair of guide bars 152 supported on the X-direction slide base 151 and extending in the Y direction, and a pair of Y-direction slide blocks 153 guided in the Y direction along the guide bars 152.

The X-direction slide rail 150 is coupled by key to the X-direction slide base 151, as shown in FIG. 10. A motor 154 is connected to an end of the X-direction slide rail 150, and an X-direction feed shaft 155 is connected to an output shaft of the motor 154.

The X-direction slide base 151 is connected to the X-direction feed shaft 155 through a link block 156. The X-direction slide base 151 is provided with a cylinder 157 for displacing the wire cutting device 28 in the Y direction. The cylinder 157 is mounted on the X-direction slide base 151, and its rod 158 is connected to the unit base 118.

One end of the guide bar 152 is supported on the X-direction slide base 151, as shown in FIGS. 10 and 12, and a stopper 159 for regulating the movement in the Y direction of the Y-direction slide block 153 is mounted on the other end thereof.

Such construction allows the motor 154 to be operated to displace the wire cutting device 28 in the X direction relative to the X base 23 and allows the cylinder 157 to displace the wire cutting device 28 in the Y direction relative to the X base 23.

The wire cutting device 28 may be fixed to a predetermined position with respect to the X base 23. In this case, the above described moving mechanism for displacing the wire cutting device 28 in the X direction and the Y direction is not required.

Description is now made of the operations of the wire laying-out apparatus according to the present embodiment.

Referring mainly to FIGS. 6, 7, 8 and 10, any one of the plurality of wire guiding devices 30 is selected so as to select the electric wire W to be laid out. Specifically, the motor 32 is driven, so that the selecting device 33 is moved in the Y direction along the selecting feed shaft 31. The selecting device 33 is stopped in the position where the engaging members 72 mounted on the operating plate 71 are engaged with the desired wire guiding device 30.

The selected wire guiding device 30 and the wire cutting device 28 are then aligned. In the alignment, the motor 25 is driven, whereby the wire laying-out head 29 is moved by a predetermined amount in the Y direction. The pressing cylinder 67 is operated, whereby the selected wire guiding device 30, which is engaged with the selecting device 33, is lowered.

Laying preprocessing is then performed. In the laying preprocessing, the forward end of the electric wire projected from the nozzle 83 of the selected wire guiding device 30 is held by the chuck hands 113 included in the wire cutting device 28. The lift cylinder 115 is then gradually operated, whereby the electric wire W is drawn out. The electric wire drawn out is clamped by the clamp claws 138 of the clamp arm mechanisms 131. Thereafter, the cylinder 157 is operated, whereby the wire cutting device 28 is displaced in the Y direction. Accordingly, the electric wire W drawn out is guided by the guide groove 134. The direction of the electric wire W drawn out is thus changed from the Z direction to the Y direction.

After the direction of the electric wire W drawn out is changed, the wire laying-out head 29 is moved by a predetermined amount forward in the Y direction, so that the selected electric wire W is drawn out to a place beyond the wire clamp 43. In this state, the pressing arm 105 of the wire pressing device 27 is lowered. Consequently, the forward end of the electric wire W is clamped by the wire clamp 43. The electric wire W projected from the wire clamp 43 is cut by the wire cutting device 28 so that the forward end of the electric wire W is equal to a predetermined length. The foregoing is the laying preprocessing.

The motors 22 and 25 are then driven, whereby the wire laying-out head 29 is displaced in the X direction and the Y direction. Accordingly, the electric wire W is laid out on the wire laying-out plate 11. The electric wire W to be laid out is hanged on the large number of wire laying-out pins 43 studded on the wire laying-out plate 11.

When the electric wire W has been laid out, the wire laying-out head 29 is moved backward in the Y direction from a place on the wire laying-out plate 11. Consequently, the electric wire W used for laying extends almost horizontally on the predetermined wire clamp 43. The electric wire W is pressed into the wire clamp 43 by the wire pressing device 27 in this state and is clamped by the wire clamp 43. After the wire laying-out head 29 is moved backward in the Y direction, the wire cutting device 28 is operated, so that the electric wire W is cut in a state where the electric wire W is projected by a predetermined length from the wire clamp 43.

When a certain electric wire has been laid out, the wire laying-out head 29 is stopped in the position. In the position, the wire guiding device 30 for guiding an electric wire to be sequentially laid out is selected. Consequently, when a certain electric wire has been laid out, the wire laying-out head 29 need not be moved so as to select an electric wire to be sequentially laid out. Therefore, the electric wire to be laid out can be replaced in a short time. Specifically, when the electric wire is replaced, the wire laying-out head need not be moved to a predetermined position, so that time required to replace the electric wire is shortened.

If the wire guiding device 30 and the electric wire cutting device 28 are in the same position in the X direction, the wire cutting device 28 need not be displaced in the X direction and the Y direction so as to cut the electric wire.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A wire laying-out apparatus, comprising:

a wire laying-out head for laying out electric wires on a wire laying-out plate for manufacturing a wiring harness, wherein the wire laying-out head includes:

a base, a plurality of wire guiding means which are arranged in a linear manner with respect to the base for guiding an electric wire to be laid out, wherein different electric wires are fed to the respective wire guiding means, and selecting means, which is movable back and forth in a linear manner parallel to a direction in which the wire guiding means are arranged, such that the single selecting means selects a wire guiding means at a position corresponding to a position wherein the selecting means is stopped, to bring the selected wire guiding means into an activated state;

Y-direction moving means connected to the base for moving the base in a predetermined Y direction, such that the base crosses the wire laying-out plate parallel to a surface of the wire laying-out plate;

X-direction moving means connected to the Y-direction moving means for moving the Y-direction moving means in a X direction parallel to the surface of the wire laying-out plate and orthogonal to the Y direction, wherein the base includes a support frame which extends in the Y direction and has a predetermined height in a Z direction orthogonal to the X direction and the Y direction, wherein the plurality of wire guiding means are arranged in the Y direction of the support frame, and each of the plurality of wire guiding means respectively includes a wire guide hole extending in the Z direction for guiding an electric wire in the Z direction, wherein the wire guiding means are respectively held movably up and down in the Z direction by the support frame, wherein the plurality of wire guiding means respectively include change means which is switchable between a pass state where an electric wire can pass through the respective wire guide hole and a stop state where an electric wire cannot pass through the respective wire guide hole, wherein the plurality of wire guiding means further respectively include tension applying means for applying tension to electric wires which pass through the wire guide holes, wherein the selecting means lowers the selected wire guiding means in the Z direction, wherein the selecting means brings the change means in the wire guiding means lowered in the Z direction into the pass state, and wherein the selecting means activates the tension applying means of the wire guiding means lowered in the Z direction; and an arch obliquely inclined and provided above the support frame, wherein a plurality of guide rollers for guiding electric wires to be fed to the respective wire guiding means are disposed in the arch.

2. The wire laying-out apparatus according to claim 1, wherein the selecting means includes:

a slide guide bar mounted on the base and extending in the Y direction parallel to the direction in which the plurality of wire guiding means are arranged, the slide guide bar being spaced apart from the plurality of wire guiding means by a predetermined distance, a selecting feed shaft extending parallel to the slide guide bar, driving means for rotating the selecting feed shaft, and a selecting unit engaged with the selecting feed shaft and movable along the slide guide bar by rotation of the selecting feed shaft.

3. The wire laying-out apparatus according to claim 2, wherein the selecting unit includes:

engaging means movable up and down and engagable with any one of the plurality of wire guiding means, and lowering driving means for lowering the engaging means.

4. The wire laying-out apparatus according to claim 1, wherein the selecting means includes:

a slide guide bar mounted on the base and extending in the Y direction parallel to the support frame and spaced apart from the support frame by a predetermined distance, a selecting feed shaft extending parallel to the slide guide bar, driving means for rotating the selecting feed shaft, and a selecting unit engaged with the selecting feed shaft and movable along the slide guide bar by rotation of the selecting feed shaft, wherein the selecting unit includes:

engaging means movable up and down and engagable with any one of the plurality of wire guiding means, lowering driving means for lowering the engaging means, and switching means provided for the engaging means for switching the state of the change means provided for the wire guiding means with which the engaging means is engaged.

5. The wire laying-out apparatus according to claim 1, wherein:

the Y-direction moving means includes Y-direction feeding means extending parallel to the surface of the wire laying-out plate, the X-direction moving means includes an X base on which a root portion of the Y-direction feeding means is mounted, and X-direction feeding means for moving the X base in the X direction parallel to one side of the wire laying-out plate.

6. The wire laying-out apparatus according to claim 5, further including:

wire cutting means mounted on a predetermined position of the X base for cutting a forward end of an electric wire which is guided by the selected wire guiding means.

7. The wire laying-out apparatus according to claim 6, wherein:

a plurality of wire clamps for clamping an electric wire extend along the X-direction feeding means, wherein the wire clamps are arranged on the wire laying-out plate, and wire pressing means for pressing an electric wire which is guided by the selected wire guiding means into the wire clamp is provided at a predetermined position of the X base.

* * * * *